US005440765A

United States Patent [19]

Weir

[11] Patent Number: 5,440,765

[45] Date of Patent: Aug. 15, 1995

[54] REVISED AUTOMATIC WATER SHUT OFF FOR STUCK OPEN FLUSH VALVES IN TOILET WATER TANKS

[76] Inventor: Richard L. Weir, 2217 Grant Ave., Dayton, Ohio 45406

[21] Appl. No.: 195,210

[22] Filed: Feb. 14, 1994

[51] Int. Cl.[6] ..... E03D 1/00; E03D 1/22

[52] U.S. Cl. ..... 4/415; 137/400

[58] Field of Search ..... 4/415, 427, 346, 367, 4/363; 137/400, 401, 403, 404, 434, 435

[56] References Cited

U.S. PATENT DOCUMENTS 4,901,377 2/1990 Weir ..... 4/415

5,285,533 2/1994 Chen ..... 4/415

*Primary Examiner*—Charles E. Phillips

[57] ABSTRACT

The automatic shut off for stuck open flush valves in toilet water tanks and water saver device depicted herein consists of a simple mechanism for installation in the water tank of a conventional water flush toilet, underneath the ball float, to provide a time delay action so that the device will not operate during normal flushing operations, but will shut off water flow into the tank when an open, mal-functioning flush valve allows the tank to empty and water flow continously to waste. The system assembly consists of two cylinders, one within the other; actuated to separate by a coil spring, ball float and spring release mechanism; to force one cylinder, with toilet tank ball float adapter, upward; shutting off the water flow into the toilet tank.

1 Claim, 2 Drawing Sheets

REVISED AUTOMATIC WATER SHUT OFF FOR STUCK OPEN FLUSH VALVES IN TOILET WATER TANKS

DESCRIPTION

IN THE DRAWINGS

Figure 1:
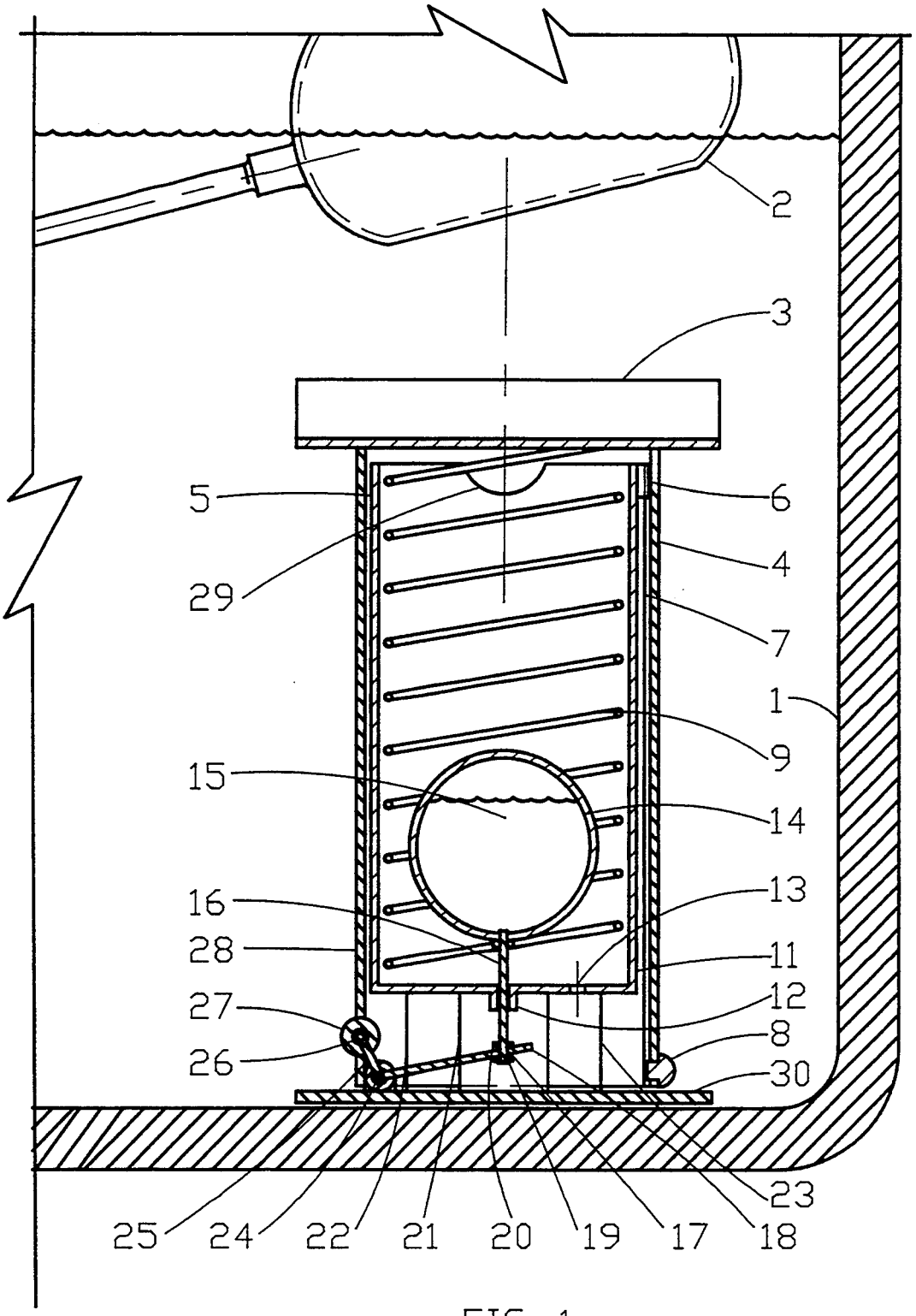
FIG. 1 is a cross section assembly view of the device installed in a toilet water tank.
Figure 2:
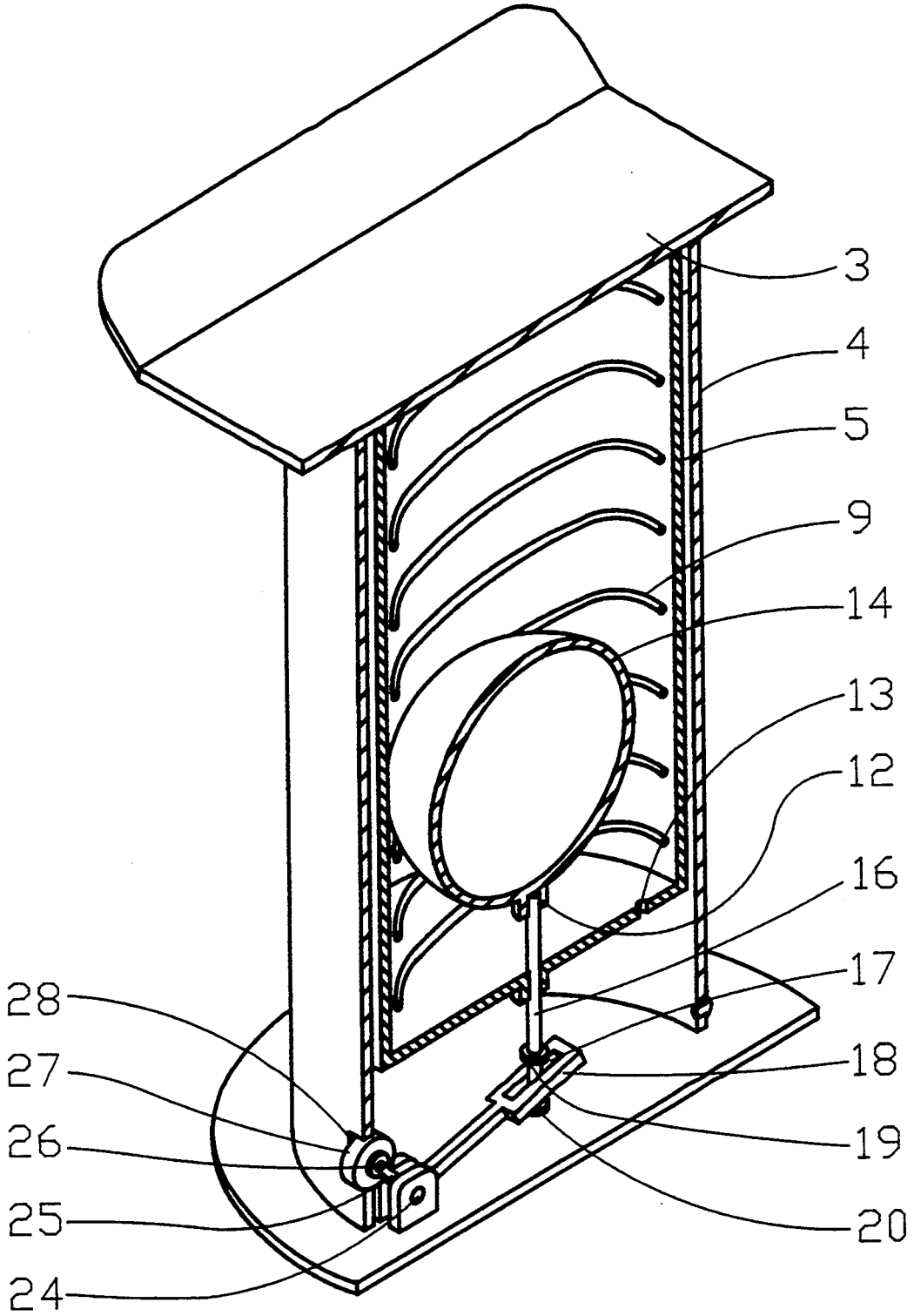
FIG. 2 is a cross section illustration view depicting details.

In FIG. I, 1 depicts a cross section portion of a conventional toilet water tank. 2 is a conventional toilet tank ball float, in position above my invention, with a full water tank. 3 is a curved ball float carrier attached to the top of external cylinder 4, which surrounds internal cylinder 5, which has an integral guide lip 6, which extends into a guide slot 7. Guide slot 7 extends from the top to the bottom of the outer wall of cylinder 4. Stop pin 8 extends into the slot near the bottom and prevents the cylinder from dis-engaging when coil spring 9 is activated by the spring release mechanism.

The mechanism is shown as imersed in water with the water line indicated by wavey line 10.

The base 11 , of internal cylinder 5, has a downward extending boss 12, with a round hole in the center. A small floatable ball 14, is located within cylinder 5 and is partially filled with water as indicated by wavey line 15. It will normally, when under water, exert pressure upward on lower ball extension rod 16, which extends downwardly thru the central hole in boss 12. Rod 16 extends thru a slot 17 in actuator arm 18. Circular snap rings 19 and 20, extend outwardly near the lower end of rod 16, above and below actuator arm 18 and control the rotary movement of actuator arm 18. Legs 21, 22 & 23 are attached to and extend downwardly from internal clyinder 5 to attach to base 30. Base 30 sits on the inside base wall of toilet water tank 1. An adhesive may be applied to the bottom of base 30 to maintain the mechanism in place.

Actuator arm 18 having an L-shape is mounted rotatably on the round pin 24, which is in turn firmly attached to base leg 22. The upward angularly extending arm 25, of actuator arm 18, has an attached horizontal pin 26 extending thru roller wheel 27. Roller wheel 27 extends thru the slot 28 in the wall of exterior cylinder 4.

A small drain hole 13 is provided in the base of cylinder 5, which slowly empties cylinder 5, when the toilet water tank is essentially empty. Semi circular slot 29 in the top edge of inner cylinder 5, allows easy access of water from the filled toilet water tank to the inside of cylinder 5.

IN OPERATION

Under normal operating conditions the mechanism described herein mearly sits under the ball float and is basically inactive except for retaining most of the water within cylinder 5 reducing water usage, by the amount retained, with each flush.

When the flush valve sticks open for an extended period of time the water tank remains essentially empty and water continues to flow uninterrupted thru the tank to waste. When this occurs the water drains out of the internal cylinder 5 thru the small bottom hole 13. The small ball float 14, with lower rod attached, then moves downwardly. Snap ring 19 then forces actuator am 18 downwardly and rotateably around pin 24. The attached roller wheel 27 is forced inwardly out of slot 28 in the wall of external cylinder 4. Coil spring 9 then forces cylinder 4, with curved float carrier 3 attached, upwardly under ball float 2. The ball float is thus forced upwardly shutting off the water flow thru the toilet water tank.

When the flush valve fault is corrected the mechanism is reset by pushing the ball float down until the toilet water tank is full as well as the inner cylinder . The upward pressure on floatable ball float 14, thru the actuator arm linkage to the roller wheel 27, will force the roller wheel out into the slot in exterior cylinder 4, retaining the coiled spring 9 in partially collapsed position within the cylinder 5.

The mechanism will remain essentially inert until the next flush valve malfunction. It is to be noted that cam actuated and other release mechanisms, that require minimal pressure for spring release, may be used for spring release, in lieu of the roller type depicted herein, and still be considered to be within the scope of this patent.

I claim:

1. A time delay device for use in a water flush toilet tank of a conventional toilet to automatically cut off water flow into said tank thru a float lever arm controlled inlet valve when a flush valve mal-functions allowing water in the tank to continuously drain from the tank for an extended period of time, said device comprising a base plate for being positioned on a bottom wall of the toilet tank, an inner cylinder having an open top and a closed bottom, said inner cylinder having an end opposite said open top mounted on said base plate, an outer cylinder having an open bottom and closed top, said outer cylinder being telescopically received over said inner cylinder, a coil spring in compression between said closed bottom and said closed top, a ball float located within said spring coils and having a rod extending through the inner cylinder closed bottom, said rod being attached to one end of a generally L-shaped actuator arm, said actuator arm having a roller wheel mounted on one end of another leg of said arm, said actuator arm being rotatably mounted about a horizontal axis on said base plate such that said roller wheel, with said ball float in an upwardmost position, will protrude through a slot in said outer cylinder, a small hole in the bottom of the inner cylinder to allow drain down of water there within when the toilet water tank is essentially empty whereby the weight of the ball float will cause said actuator arm to rotate in a clock-wise manner about said axis thus moving said roller wheel from said slot so as to release said outer cylinder for movement via force applied by said coil spring, said movement will cause said float lever arm to be moved to a closed position of said inlet valve.

* * * * *